US008997666B2

(12) United States Patent
Player

(10) Patent No.: US 8,997,666 B2
(45) Date of Patent: Apr. 7, 2015

(54) ELEVATED FIXED-GRATE APPARATUS FOR USE WITH MULTI-FUEL FURNACES

(76) Inventor: Tyler Marshall Player, Chapman, ME (US)

( * ) Notice: Subject to any disclaimer, the term of this patent is extended or adjusted under 35 U.S.C. 154(b) by 245 days.

(21) Appl. No.: 13/220,634

(22) Filed: Aug. 29, 2011

(65) Prior Publication Data

US 2011/0308511 A1 Dec. 22, 2011

(51) Int. Cl.

| | |
|---|---|
| ***F23B 60/00*** | (2006.01) |
| ***F23B 40/04*** | (2006.01) |
| ***F23L 9/06*** | (2006.01) |
| *F23J 1/00* | (2006.01) |

(52) U.S. Cl.

CPC ..... *F23B 60/00* (2013.01); *F23B 40/04* (2013.01); *F23J 1/00* (2013.01); *F23L 9/06* (2013.01)

(58) Field of Classification Search

CPC ..... F23H 1/06; F23H 1/08; F23H 7/02; F23H 9/02; F23H 13/00; F23H 13/02; F23H 13/04; F23H 13/08; F23H 15/00; F23H 2700/005; F23B 60/00; F23B 60/02; F23B 40/04; F23J 1/00; F23L 9/06

USPC ..... 110/287, 291, 277, 247, 182.5, 338, 110/298, 259, 323, 324, 325; 126/152 R, 126/163 R, 182, 152 B, 150, 151

See application file for complete search history.

(56) References Cited

U.S. PATENT DOCUMENTS

| | | | | |
|---|---|---|---|---|
| 1,494,039 A | | 5/1924 | Thomas | |
| 1,673,668 A | * | 6/1928 | Erion et al. | 110/287 |
| 1,957,921 A | | 5/1934 | White | |
| 2,369,995 A | * | 2/1945 | Arnold | 110/326 |
| 2,444,985 A | | 7/1948 | Fulton | |

(Continued)

FOREIGN PATENT DOCUMENTS

| | | | | |
|---|---|---|---|---|
| CN | 101439979 | * | 5/2009 | C04B 35/66 |
| EP | 1013991 A1 | * | 6/2000 | F23G 5/00 |

(Continued)

OTHER PUBLICATIONS

Krosaki Harima: Refractories business: "What is a refractory material?": <http://web.archive.org/web/20100127031146/http://www.krosaki.co.jp/english/c4/c_4_1.html>. Accessed Mar. 6, 2014.*

(Continued)

*Primary Examiner* — Kenneth Rinehart
*Assistant Examiner* — Tavia Sullens
(74) *Attorney, Agent, or Firm* — Dennis R. Haszko

(57) ABSTRACT

A combustion device in the form of an elevated fixed-grate that includes arcuately shaped solid refractory brick with ribs placed thereunder so as to allow horizontal air flow for fuel combustion. The brick are arranged atop one another in a stacked concentric configuration that forms a central fuel passageway and allows cascading of a fuel pile throughout the combustion stages. The device provides the benefit of proper de-ashing online while distributing the underfire air radially around the fuel pile. The elevated design of the bricks allows the air to be evenly distributed throughout the fuel pile and further allows the isolation of overfire and underfire air. Segregating overfire and underfire air in an evenly distributed manner allows the burner to combust a wide range of fuel moisture contents without modifying the mechanical components of the burner.

8 Claims, 7 Drawing Sheets

(56) References Cited

U.S. PATENT DOCUMENTS

| | | | | | |
|---|---|---|---|---|---|
| 3,244,164 | A | | 4/1966 | Cooper | |
| 3,693,791 | A | | 9/1972 | Beck | |
| 3,735,011 | A | * | 5/1973 | Soykan | 373/164 |
| 3,812,794 | A | | 5/1974 | Taylor | |
| 3,881,431 | A | | 5/1975 | DiSabatino | |
| 4,074,680 | A | | 2/1978 | Gooding | |
| 4,246,851 | A | | 1/1981 | Bergh | |
| 4,377,117 | A | | 3/1983 | Kolze et al. | |
| 4,388,876 | A | * | 6/1983 | Burton | 110/277 |
| 4,633,790 | A | * | 1/1987 | Kosaka | 110/347 |
| 4,736,730 | A | | 4/1988 | Robertson | |
| 5,044,288 | A | | 9/1991 | Barlow | |
| 2005/0229824 | A1 | * | 10/2005 | Lefcort | 110/268 |

FOREIGN PATENT DOCUMENTS

| | | | |
|---|---|---|---|
| JP | 73013681 B | * | 2/1954 |
| JP | 58022818 | | 2/1983 |
| JP | 07042923 | | 2/1995 |

OTHER PUBLICATIONS

The Cast Iron Air Brick Company Catalogue. Cover Page. Autumn & Winter 2009.*

"Segment." in The American Heritage Dictionary of the English Language. Boston: Houghton Mifflin, 2011. http://search.credoreference.com/content/entry/hmdictenglang/segment/0 (accessed Aug. 9, 2014).*

* cited by examiner

ELEVATED FIXED-GRATE APPARATUS FOR USE WITH MULTI-FUEL FURNACES

FIELD OF THE INVENTION

The present invention relates generally to carbon-based fuel furnaces. More particularly, the present invention relates to an improved grate configuration to enhance combustion of fuel of varying quality.

BACKGROUND OF THE INVENTION

In the art of wood and waste combustion systems, a variety of well known techniques and devices are available for heat generation of various kinds. In particular, the wood products manufacturing industry includes combustion techniques and devices which include heat sources for drying equipment. Oftentimes, such combustion techniques and devices are intended to burn all kinds of wood and potentially other solid-carbon-based fuel sources. Such varying fuel sources include waste that is sourced from wood products manufacturing. Not only do the fuel sources vary in composition and physical form, but such fuel sources also vary considerably in terms of moisture content. Accordingly, within this field, there have been many devices seeking to provide improved combustion.

U.S. Pat. No. 2,444,985 discloses a fuel burner for the combustion of solid fuels comprising a blower, a conveyor screw, a cast iron heater surrounded by a sheet metal jacket provided with one or more hot air outlets, cold or return air inlets, a smoke pipe, a furnace base which forms the ash pit, an ash conveyor trough carrying a conveyor screw, refractory walls to enclose a gas chamber, and a burner wherein the usual grates normally provided in the bottom of the heater may be removed or omitted and wherein the inside of the base is lined with a refractory wall forming an interior circular chamber lined with heat refractory material. The burner of this device is installed so that its center axis is offset from the center of the circular chamber.

U.S. Pat. No. 4,074,680 discloses a fireplace structure for burning a combustible fuel comprising an adjustable hood, a stationary smoke pipe, a fire support base, a lowermost base portion for operable mounting of the fireplace base upon a floor surface, a cylindrical support means with a upwardly opening plenum spaced within the fireplace base, a firebrick lining, and a grating means made of a plurality of fire brick laterally and vertically spaced to define updraft air passages for ambient air supplied from a bottom portion of the plenum, wherein the fire brick are laterally and vertically spaced to define updraft passages in addition to supporting any form of combustible material such as coal, wool, charcoal versions of the same, and an ash auger.

U.S. Pat. No. 3,812,794 discloses a combustion furnace having a grate formed as a plurality of downward leading steps from an upper to a lower region with a number of separated, outwardly flaring openings among the steps including a material ram plate, and a stair-step grate formed of a number of refractory bricks which each extend slightly beyond the one above it wherein each of the refractory bricks has a passageway extending through it parallel to the horizontal surface and terminating in an upwardly flaring opening.

U.S. Pat. No. 4,377,117 discloses a furnace for burning dry or wet wood waste products such as hogged bark and the like encompassing a storage bin which contains particulate wood waste material to be burned, a rotary screw conveyor, an intermediate hopper, a rotary feeder, an air flow conduit for a blower, a boiler furnace, a grating structure or grate with spaced-apart support beams having a plurality of parallel rows of bricks positioned thereon with at least some of the rows of bricks maintained a uniform distance from other rows of bricks by spacers, hot air inlet conduits positioned below the grate, and an adjustable intake.

Traditionally, combustion devices have included a fixed grate furnace, though improved versions have displaced the fixed grate types with the walking grate system. This style offers online de-ashing and elevated metal grate bars. The online de-ashing avoids problems associated with a fixed floor furnace, but creates a furnace that cannot burn excessive amounts of dry fuel without the need of wetting the fuel or something similar that drastically complicates the fuel supply arrangement to these combustion devices. In addition, this style of combustion device is typically extremely expensive due to the metal bars in the floor. This is impractical for small wood products manufacturing operations to purchase. Some variations on the fixed grate include a fixed yet sloped floor grate.

While many such solutions exist to the combustion of wood and waste, problems are common to most every configuration of walking grates, fixed floor grates, and fixed floor bins. For example, walking grates do not allow the burning of fuel below 40% moisture content without damaging the metal grates. As well, fixed floor grates often plug and are hard to clean and properly gasify the products of combustion without a mechanically large furnace area. Still further, fixed floor bins are nearly impossible to effectively de-ash while online and prove very difficult to keep air infiltration down.

It is, therefore, desirable to provide improved de-ashing online while improving air distribution around the combustion pile. Moreover, it is desirable to provide a combustion device capable of burning a wide range of fuel moisture contents without the need for modifying the mechanical components of the burner for the given fuel. It is further desirable to enable the combustion of low moisture content fuel without inducing rapid wearing or requiring constant maintenance.

SUMMARY OF THE INVENTION

It is an object of the present invention to obviate or mitigate at least one disadvantage of previous combustion devices. The present invention provides the benefit of proper de-ashing online while distributing the underfire air radially around the pile. The elevated design of the bricks allows the air to be evenly distributed throughout the fuel pile and further allows the isolation of overfire and underfire air. Segregating overfire and underfire air in an evenly distributed manner allows the burner to combust a wide range of fuel moisture contents without modifying the mechanical components of the burner. Using bricks eliminates the problems created by using metal based grates in the floor of the furnace, thus avoiding rapid wear and constant maintenance during the burn of low moisture content fuel.

In general, the present invention includes a round vertical combustion chamber. The chamber is composed of several isolated sections that are fed through an air header and controlled through damper actuators. The grate bricks are arranged in a radial fashion and elevated to allow smooth airflow throughout the pile. This also allows proper three-stage combustion of the wood fuel whereby drying, gasifying, and heat release all occur in an appropriate fashion across the grate area. Thus, this grate area is specifically designed for a wide range of moisture in the fuel supplied. The inventive configuration of elevated bricks is arranged in a radial pattern so as to solve the problems of both isolating underfire/overfire air and of automatic de-ashing. The elevated configuration allows maximization of the air flow through the grate area without compromising the high heat capability of refractory. This allows the inventive device to burn low moisture fuel without damaging the grate. Moreover, the present invention as claimed provides an invention that materially enhances the quality of the environment by materially contributing to the more efficient utilization and conservation of energy resources by using, with high efficiency, wood waste from the wood manufacturing industry.

In a first aspect, the present invention provides an elevated fixed-grate apparatus for use in a multi-fuel furnace, the apparatus including: a first course of solid refractory bricks forming a base, more than one subsequent course of the solid refractory bricks arranged atop the base, the first course and each the subsequent course being arranged in a concentric manner, each the subsequent course having an outer peripheral dimension smaller than an immediately preceding course upon which the subsequent course is placed, the bricks each formed as an arcuate segment of a circle, and each the course being vertically spaced from one another so as to allow passage of air between each the course.

In a further embodiment, there is provided a refractory brick of an elevated fixed-grate apparatus for use in a multi-fuel furnace, the refractory brick including: a solid refractory core formed as an arcuate segment of a circle; a pair of lateral ribs located at opposite extreme bottom edges of the solid refractory core; a central rib located at a center bottom of each the solid refractory core; and each the rib being oriented radially relative to the arcuate segment forming the solid refractory core.

In further aspect, the present invention provides an elevated fixed-grate apparatus for use in a multi-fuel furnace, the apparatus including: a stepped arrangement of solid refractory bricks formed by circular courses of the bricks concentrically placed atop one another; each subsequent upper one of the circular courses having an outer peripheral dimension smaller than an immediately preceding course upon which a subsequent course is placed so as to form the stepped arrangement; and each the brick being formed as an arcuate segment of a circle and including at least one radially placed passageway for movement of combustion gases between the circular courses of the bricks.

Other aspects and features of the present invention will become apparent to those ordinarily skilled in the art upon review of the following description of specific embodiments of the invention in conjunction with the accompanying figures.

BRIEF DESCRIPTION OF THE DRAWINGS

Embodiments of the present invention will now be described, by way of example only, with reference to the attached Figures.

DETAILED DESCRIPTION

Figure 1:
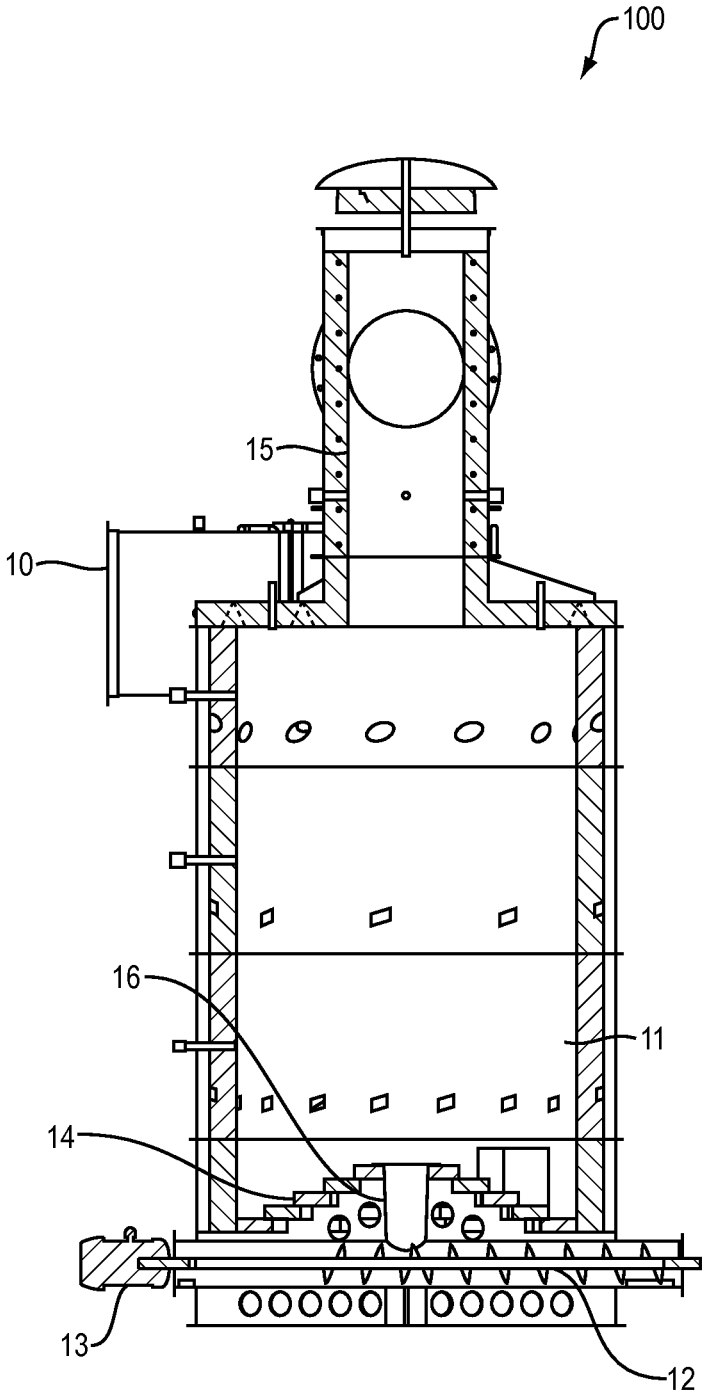
FIG. 1 is a generalized schematic of a multi-fuel furnace with an elevated fixed-grate in accordance with the present invention.

Generally, the present invention provides a combustion apparatus in the form of a multi-fuel furnace with an inventive fixed-grate that is elevated and center-fed with wood fuel. With specific reference to FIG. 1, there is shown a generalized schematic of a multi-fuel furnace 100 with an elevated fixed-grate 14 in accordance with the present invention. It should be understood that a variety of furnace configurations may be possible without straying from the intended scope of the present invention and that the configuration shown in FIG. 1 is only one possible configuration. Here, basic furnace elements are illustrated including an auger mechanism 12 powered by motor 13 for providing a center-fed input of combustible fuel such as, but not limited to, waste wood, sawdust, wood chips, bark, or any residual waste product from wood manufacturing. The inventive fixed-grate provides enhancements a multi-fuel furnace which helps to improve the overall quality of the environment. This is accomplished via increased efficiency in the utilization and conservation of energy resources by better use of wood waste from the wood manufacturing industry as described in more detail herein below. Flue gases exit the furnace 100 primarily via a flue 15 and usable heat exits via a heat conduit 10.

Though not shown, the auger mechanism 12 itself may be preceded by another mechanism to provide fuel in any manner such as via a simple chute or a more complex conveyor system depending upon the given configuration. It should be readily apparent to one of skill in the art of wood manufacturing that any other device or process may, if desired, be attached to the heat conduit 10 such as a rotary dryer or any other common heat processing element. Though not shown, heat may be extracted from the combustion process via the heat conduit 10 or in any conventional manner including, without limitation, a thermal water jacket surrounding the refractory, fluid pipes within the flue gas stream, or any heat transfer mechanism suitable for the given configuration.

In operation, combustible fuel is center-fed into the elevated fixed-grate 14 via the auger mechanism 12 through a central feed conduit 16. Although alternative shapes are possible without straying from the intended scope of the present invention, the round shape of the vertical combustion chamber 11 lends itself to uniform heating of the combustion pile. As well, this round shape coincides with the concentric courses of grate bricks described further herein below. Due to the arrangement of concentric courses of grate bricks, the formation and subsequent burning of the combustion pile thereupon provides for residual ash to come to rest at the outer peripheral base of the fixed-grate 14.

The basic structural elements of the furnace 100 including the heat conduit 10, combustion chamber 11, auger mechanism 12, motor 13, and flue 15 are well-known elements and are therefore not further described herein. The combustion chamber 11 can be composed of several isolated sections (not shown) that are fed through an air header and controlled through damper actuators in any known manner. Indeed, each of these basic structural elements may vary in known shape, form, or complexity without impacting upon the novelty of the present invention. Such novelty rests in the combination of the aforementioned structural elements with a unique arrangement, as discussed in further detail herein below, of concentric brick courses which form the elevated fixed-grate 14.

Figure 2:
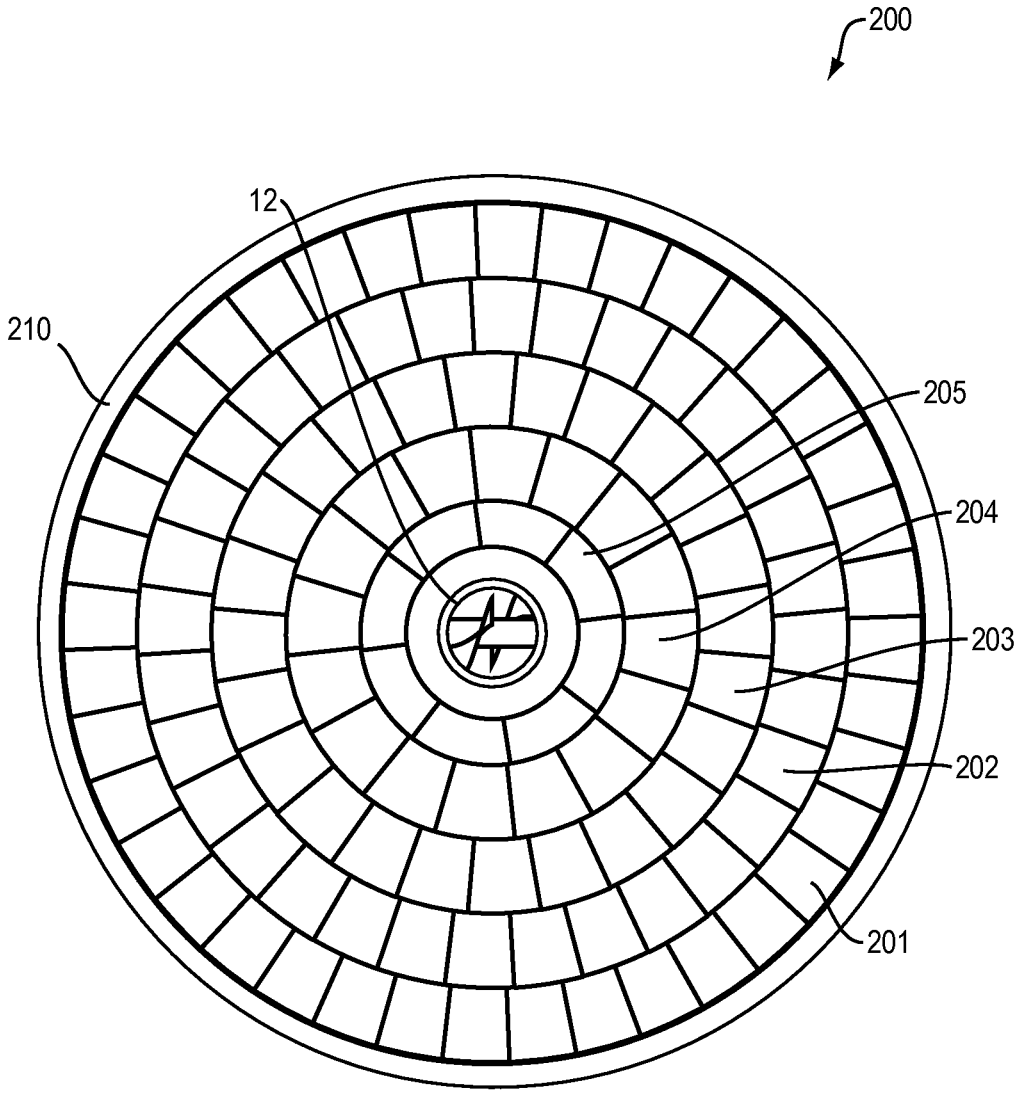
FIG. 2 is a top-view showing the concentric arrangement of the elevated fixed-grate in accordance with the present invention.

FIG. 2 is a top-view that shows the arrangement 200 of concentric courses 201, 202, 203, 204, and 205 of grate bricks which together form the elevated fixed-grate 14. Here, the outer peripheral base 210 which may include a recess for collection of residual ash can be seen as well as the auger mechanism 12 which feeds fuel to the surface of the top course 205 from which such fuel cascades over subsequent courses 202, 203, 204, and 205 towards the outer peripheral base 210. While five courses are shown, it should be understood that any number of courses may be provided without straying from the intended scope of the invention. Indeed, a larger overall furnace would require a large arrangement of bricks which may vary in the number of courses or further may vary in the size of each brick that comprise the courses where such variation is also within the scope of the present invention. The grate bricks are arranged in a radial fashion and elevated so as to allow smooth airflow throughout the combustion pile. This also provides for proper three-stage combustion of the wood fuel whereby drying, gasifying, and heat release all occur in an appropriate fashion across the grate area. In this manner, a wide range of allowable moisture content in the fuel is possible due to the three-stage combustion. This inventive configuration of concentric courses of elevated bricks serves to both isolate underfire air from and overfire air and also to automatically de-ash the fixed-grate area. Moreover, the elevated configuration allows maximization of the air flow through the grate area without compromising the high heat capability of refractory. This allows the present inventive device to burn low moisture fuel without damaging the grate. For purposes of the present invention, allowable moisture content for the fuel entering the combustion chamber 11 can range from 1% to 60%.

Figure 3:
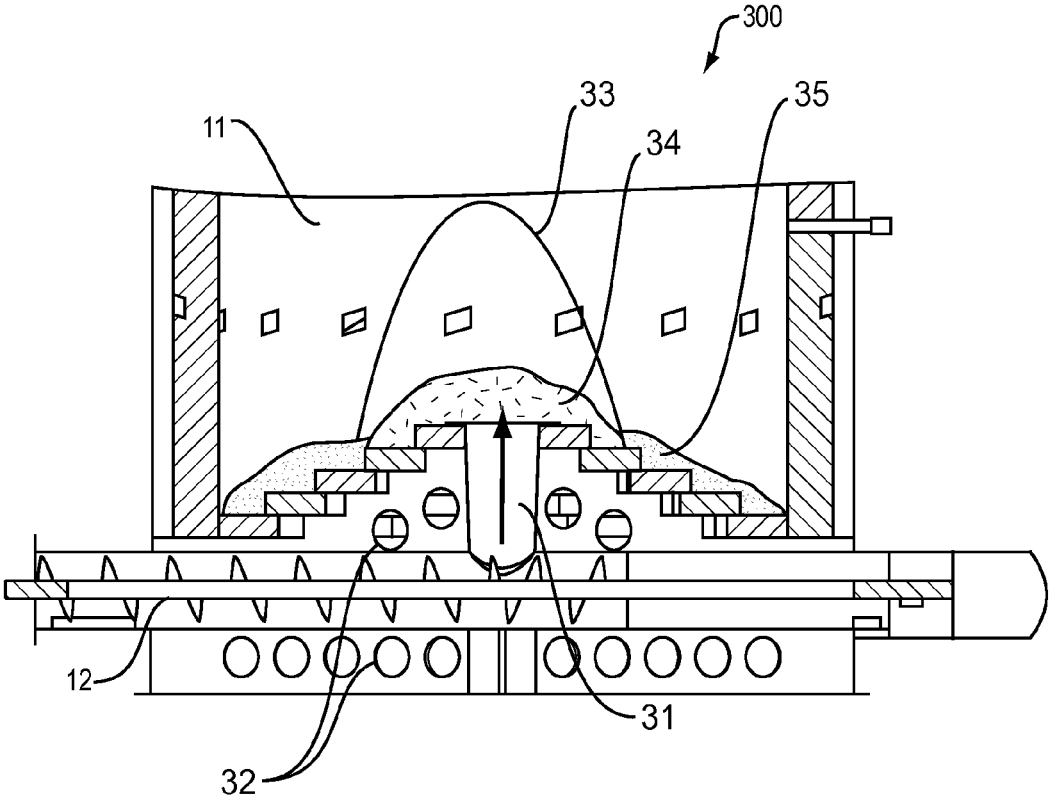
FIG. 3 is a cross-sectional side view illustrating the concentric arrangement of the elevated fixed-grate in accordance with the present invention.

With regard to FIG. 3, the three-stages of combustion enabled by the present invention are clearly illustrated. Here, a close-up, cross-sectional side view 300 shows the concentric arrangement of the elevated fixed-grate. Fuel is fed upwardly (as shown by an upward pointing arrow) through a contiguous, cylindrical inner cavity 31 from the auger mechanism 12. In this manner, raw fuel 34 having an elevated moisture content will enter the combustion chamber 11 for the initial drying stage. Because the brick grates are arranged concentrically in a stepped manner, the dried fuel is allowed to cascade down the outer edges of the elevated fixed-grate. The dried fuel then enters the gasifying stage (indicated by dome 33) whereby the majority of energy is released from the fuel into the combustion chamber 11. Underfire air fed through holes 32 in the support structure flows through passageways (explained in further detail below) in the bricks and feeds combustion during the gasifying stage.

Such underfire air is physically separated from the overfire air flow. The overfire air flow serves more to dry the fuel in the initial combustion stage. Accordingly, underfire air is typically drier and hotter which aids in the superheating aspect of the gasification stage. During combustion, the residue 35 of gasification continues to cascade down the outer edges of the elevated fixed-grate to the final burn-out stage at which time a final ash is produced. The final ash comes to rest at the base of the elevated fixed-grate against the round walls of the combustion chamber 11. As previously suggested in regard to FIG. 2, an optional recess along the floor where the final ash comes to rest can be provided to allow for automatic de-ashing. It is this addition of a refractory lined chamber at the bottom allows the ash to collect in this chamber for subsequent removal.

Figure 4:
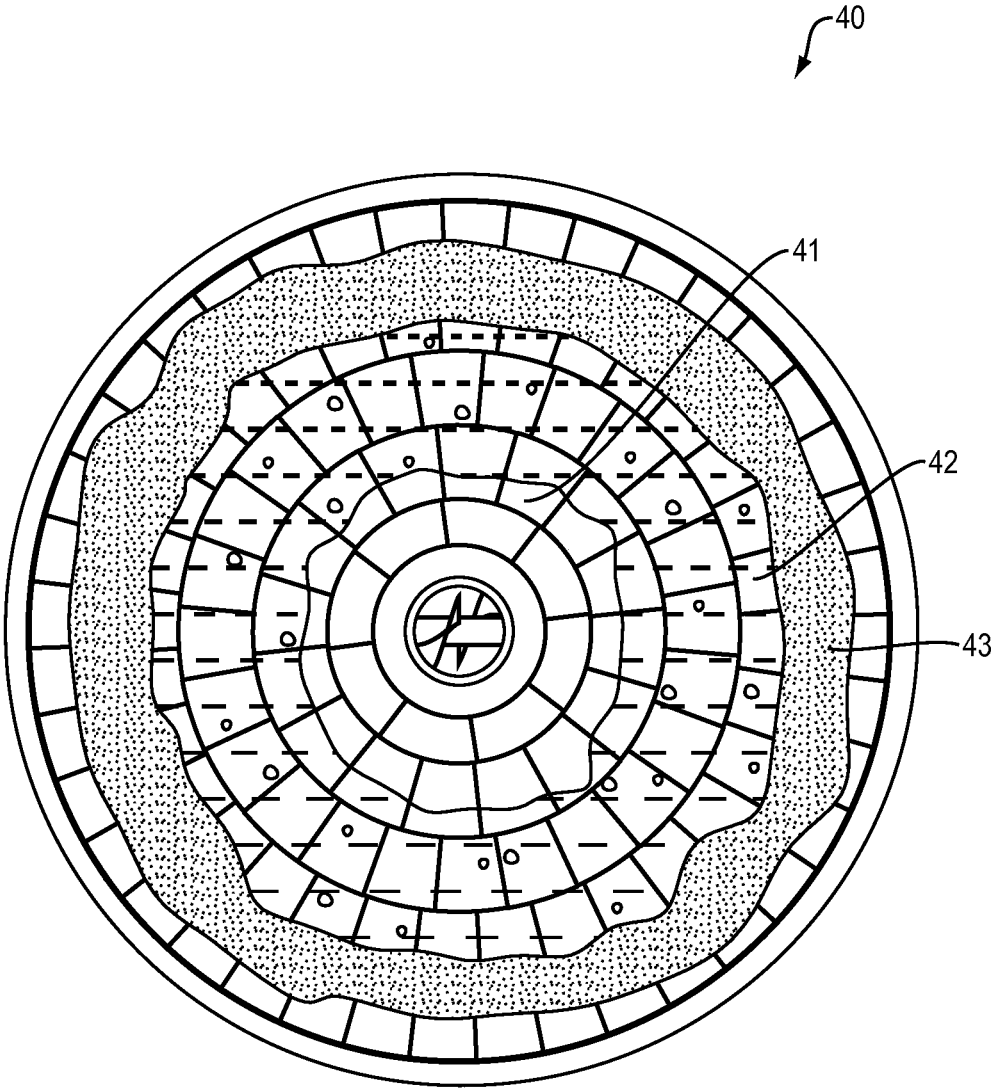
FIG. 4 is a top-view illustrating the three primary fuel stages of a combustion pile as seen atop the concentric arrangement of FIG. 2.

In terms of the combustion pile, FIG. 4 is provided to show the three primary combustion stages 40 from a top down perspective. FIG. 4 is effectively an identical illustration relative to FIG. 2 with the addition of fuel stages overlaid there upon. Here, the manner in which the combustion pile cascades out from the center in a circular manner atop the concentric arrangement of FIG. 2 can be seen. The innermost circular portion 41 illustrates the fresh fuel initially center-fed from below through the contiguous, cylindrical inner cavity via the auger mechanism (shown at center) and in the initial stage drying on the fixed-grate. Beyond the innermost circular portion 41 is shown a central circular portion 42 which represents the gasification stage of the fuel. Lastly, the outermost circular portion 43 represents the burn-out stage whereby residual ash will eventually accumulate at the periphery of the outermost circular portion 43. As mentioned, such ash can then drop down into a recessed area for subsequent removal from the combustion chamber floor. In this manner, de-ashing of the fixed-grate is accomplished in a passive manner without requiring any additional mechanisms.

Figure 5:
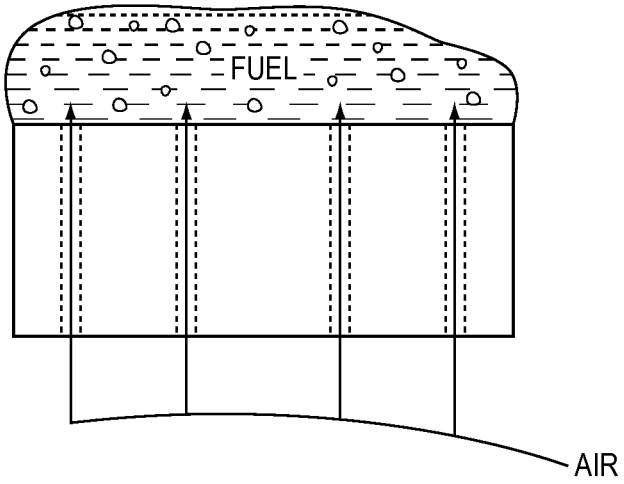
FIG. 5 (PRIOR ART)
FIG. 5 is a prior art illustration showing a side view of one type of prior art cast brick.
Figure 6:
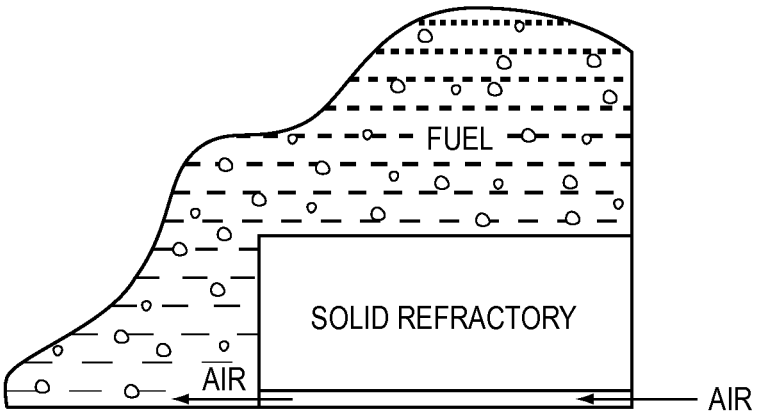
FIG. 6 is an illustration showing a side view of a single fixed-grate brick in accordance with the present invention.

For the sake of comparison of the present invention to standard refractory configurations, FIG. 5 and FIG. 6 are provided. Specifically, FIG. 5 is a prior art illustration showing a side view of one type of prior art cast brick whereby a fuel pile rests upon a typical fire brick having air holes cast therein. In such structure, the air holes are vertical and typically plug with ash so as to require a significant amount of maintenance in the form of de-ashing procedures. Moreover, such known configurations with holes in the refractory allow the refractory itself to expand and contract, thus causing cracking and eventual premature failure. In contrast, FIG. 6 is an illustration showing a side view of a single fixed-grate brick in accordance with the present invention. Here, the air flow is provided via a horizontally arranged air passage beneath the solid refractory brick. This horizontal orientation of the air passage advantageously alleviates plugging of the air passages without the need for holes with the refractory itself. Moreover, the concentric arrangement of overlapping courses of radially arranged bricks in accordance with the present invention in combination with the horizontal air passages facilitates the cascading characteristics of a combustion pile utilizing the present invention. In this manner, this arrangement provides the aforementioned automatic de-ashing as the combustion pile cascades from the center top of the fixed-grate as fresh fuel in the drying stage through the mid-level gasifying stage and ultimately to the bottom peripheral edge of the fixed-grate upon the burn out stage whereby final ash rests.

Figure 7:
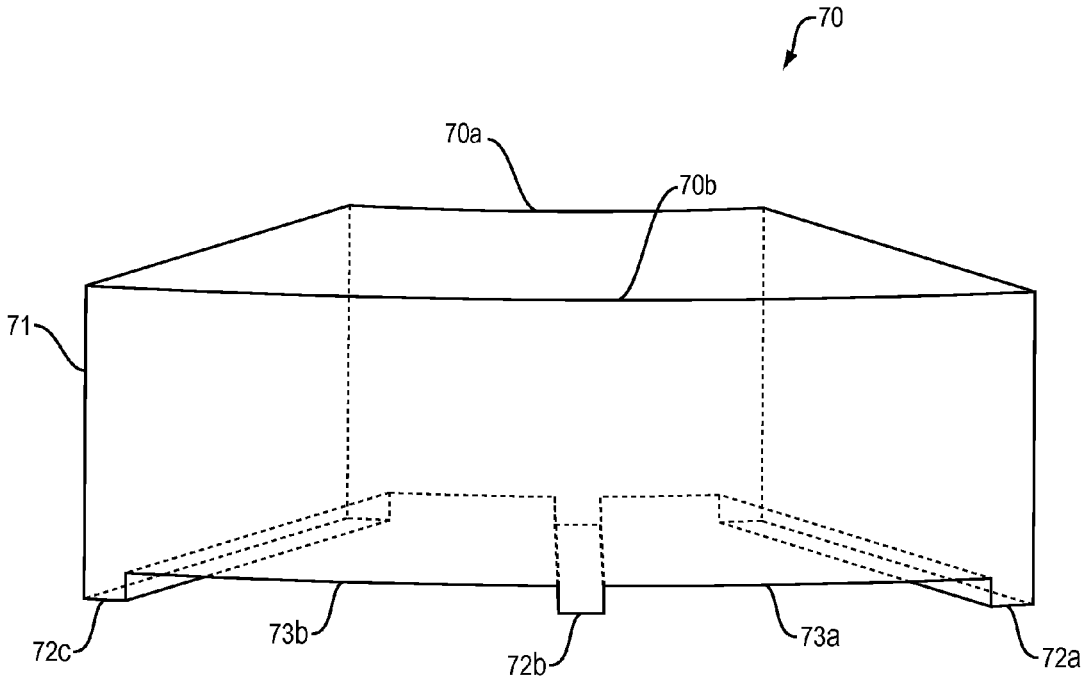
FIG. 7 is a perspective view of the single fixed-grate brick of FIG. 6 in accordance with the present invention.

Each individual brick in accordance with the present invention is formed generally as an arcuate segment of a circle. In FIG. 7, this formation is shown by way of a three-dimensional perspective view of a single fixed-grate brick of FIG. 6 in accordance with the present invention. Here, the basic structural elements of a single fixed-brick 70 are shown to include a solid refractory section 71 held in an elevated position via ribs 72*a*, 72*b*, and 72*c*. The ribs 72*a*, 72*b*, and 72*c* include lateral ribs 72*a* and 72*c* and central rib 72*b* located at the bottom surface of each single fixed-brick 70. Each of the ribs 72*a*, 72*b*, and 72*c* is oriented radially relative to the arc of the given brick. The voids created by the ribs 72*a*, 72*b*, and 72*c* form horizontal passageways 73*a* and 73*b*. In forming the elevated fixed brick apparatus in accordance with the present invention, each single fixed-grate brick is arranged into a base forming a complete ring of bricks upon which a subsequent course of bricks with fewer bricks is placed thereby forming a progressively smaller completed ring of incrementally smaller individual fixed-grate bricks. It should be readily apparent that the inner peripheries 70*a* and outer peripheries 70*b* of each brick in each course of bricks align and the inner peripheries 70*a* surround the contiguous, cylindrical inner cavity (as previously shown in FIG. 3) of the assembled elevated fixed-grate.

Figure 8:
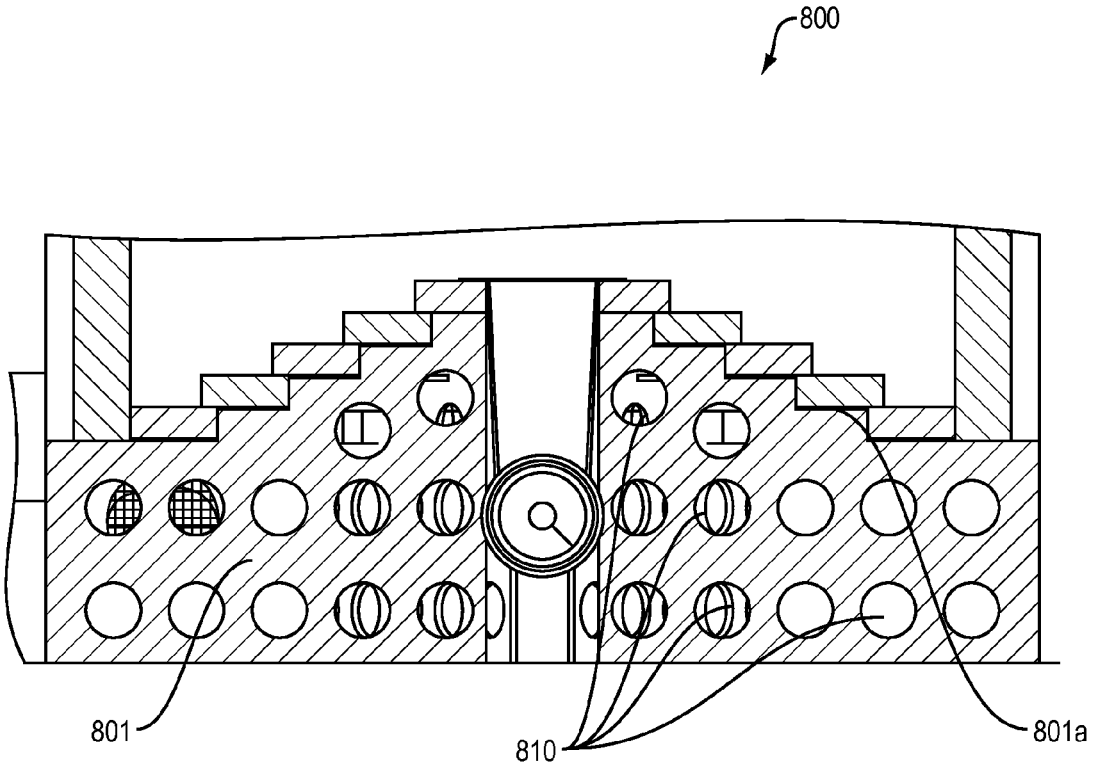
FIG. 8 is an illustration showing a cross-sectional view of the stepped support structure underlying the concentric arrangement of the elevated fixed-grate in accordance with the present invention.

As can further be seen by way of FIG. 8 in a simplified cross-section 800, the bricks 70 are situated on a stepped support structure 801 that generally mirrors the stepped arrangement of the bricks 70. The stepped support structure 801 may be formed from steel of a thickness and quality sufficient to withstand long term use in a high heat environment. This stepped support structure 801 is tied together underneath the main brick support plates 801*a* to support the overall weight of the inventive grate. The main brick support plates 801*a* may be integrally formed with the stepped support structure 801 or may be separately formed and laid atop the stepped support structure 801. The main brick support plates 801*a* are designed such that the combustion air supplied to the underfire air is distributed in a homogenous pattern throughout the circular pattern of the bricks 70. These plates serve the dual purpose of distributing air flow (via holes 810) and structural support of the overall combustion grate made up of the bricks 70, support plate 801*a*, and support structure 801. While one particular configuration for a stepped support structure 801 is shown in FIG. 8, it should be readily apparent that any suitable underlying structural support may be used so long as airflow is enabled to the brick undersides while structurally supporting the courses of bricks 70.

The above-described embodiments of the present invention are intended to be examples only. Alterations, modifications and variations may be effected to the particular embodiments by those of skill in the art without departing from the scope of the invention, which is defined solely by the claims appended hereto.

What is claimed is:

1. An elevated fixed-grate apparatus for use in a furnace for combusting residual wood waste product with a wide range of moisture content, said apparatus comprising:

a first course of solid refractory bricks forming a base, more than one subsequent course of said solid refractory bricks arranged atop said base, said first course and each said subsequent course being arranged in a concentric manner thereby isolating underfire air located below said solid refractory bricks from overfire air located above said solid refractory bricks, each said subsequent course having an outer peripheral dimension smaller than an immediately preceding course upon which said subsequent course is placed, said first course and each said subsequent course are stacked one atop another so as to form a contiguous stepped top surface which includes an opening in a topmost one of said subsequent courses from which said residual wood waste product is supplied, said contiguous stepped top surface being solid in its horizontal direction and supporting said residual wood waste product during combustion thereof, each said course having an inner peripheral dimension such that an inner cavity is formed by said courses being stacked one atop another, said bricks each formed as an arcuate segment of less than a complete a circle, each said solid refractory brick includes integral portions therewith forming a pair of lateral ribs located at respective opposite bottom edges of each said solid refractory brick and a central rib located on a bottom center of each said solid refractory brick, each said rib extending completely across a bottom surface of each said solid refractory brick and being oriented radially relative to courses and being dimensioned in a manner sufficient to provide vertical spacing of said solid refractory brick of each said subsequent course from said solid refractory brick of said immediately preceding course, and said vertical spacing providing a horizontally arranged air passage between each said course, said horizontally arranged air passage enabling transfer of underfire air from below said solid refractory bricks to above said solid refractory bricks.

2. The apparatus as claimed in claim 1, wherein said inner cavity forms a passageway for fuel said residual wood waste product.

3. The apparatus as claimed in claim 2, wherein fuel said residual wood waste product entering said passageway is allowed to cascade from a topmost one of said courses towards said base while being horizontally fed combustion air via each said passageway for air.

4. The apparatus as claimed in claim 3, wherein a recess is provided at a periphery of said base for capture of residual ash produced through combustion of fuel said residual wood waste product.

5. A refractory brick of an elevated fixed-grate apparatus for use in a furnace for combusting residual wood waste product with a wide range of moisture content, said refractory brick comprising:

a solid refractory core formed as an arcuate segment of less than a complete circle;

a pair of lateral ribs located on the bottom of the brick at opposite edges of said solid refractory core, said pair of lateral ribs formed integrally with said solid refractory core;

a central rib centrally located on the bottom of each said solid refractory core; and each said rib being oriented radially arcuate segment sector forming said solid refractory core, said central rib formed integrally with said solid refractory core;

said refractory brick includes a first number of refractory bricks that are capable of forming a first circular course and an additional number of bricks beyond the first number of bricks that are used to form more than one subsequent circular course, said first and subsequent circular courses together isolating underfire air located below said refractory bricks from overfire air located above said refractory bricks;

said first circular course and each said subsequent circular course are stacked one atop another in a concentric manner so as to form a contiguous stepped top surface which includes an opening in a topmost one of said subsequent courses from which said residual wood waste product is supplied, said contiguous stepped top surface being solid in its horizontal direction and supporting said residual wood waste product during combustion thereof, each said subsequent circular course having an outer peripheral dimension smaller than an immediately preceding circular course upon which said subsequent circular course is placed, each said circular course having an inner peripheral dimension such that an inner cavity is formed by said courses being stacked one atop another;

each said rib extends completely across a bottom surface of each said solid refractory brick and is dimensioned in a manner sufficient to provide vertical spacing of said solid refractory cores of each said subsequent circular course from said solid refractory cores of said immediately preceding circular course, said vertical spacing providing a horizontally arranged air passage between each said course, said horizontally arranged air passage enabling transfer of underfire air from below said solid refractory bricks to above said solid refractory bricks.

6. The refractory brick as claimed in claim 5, wherein said inner cavity forms a passageway for fuel said residual wood waste product.

7. The refractory brick as claimed in claim 6, wherein said residual wood waste product entering said passageway is allowed to cascade from a topmost one of said circular courses towards said first circular course while being horizontally fed combustion air via each said passageway for air.

8. The refractory brick as claimed in claim 7, wherein a recess is provided at a periphery of said first circular course for capture of residual ash produced through combustion of said residual wood waste product.

* * * * *

UNITED STATES PATENT AND TRADEMARK OFFICE

CERTIFICATE OF CORRECTION

PATENT NO. : 8,997,666 B2
APPLICATION NO. : 13/220634
DATED : April 7, 2015
INVENTOR(S) : Tyler Marshall Player It is certified that error appears in the above-identified patent and that said Letters Patent is hereby corrected as shown below:

In the Claims

Column 8, line 17, claim 2, delete “fuel”

line 19, claim 3, delete “fuel”

line 26, claim 4, delete “fuel”

line 40, claim 5, after “radially” insert -- relative to said -- line 40, claim 5, delete “sector”

Column 9, line 9, claim 6, delete “fuel”

Signed and Sealed this
Fifth Day of January, 2016

Michelle K. Lee

Michelle K. Lee
*Director of the United States Patent and Trademark Office*